US007896713B2

(12) United States Patent
Jensen et al.

(10) Patent No.: US 7,896,713 B2
(45) Date of Patent: Mar. 1, 2011

(54) BATTERY CLAMP

(75) Inventors: Robert Jensen, Clarks Grove, MN (US); Scott Opsahl, Lakeville, MN (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 12/394,978

(22) Filed: Feb. 27, 2009

(65) Prior Publication Data

US 2010/0221961 A1 Sep. 2, 2010

(51) Int. Cl.
*H01R 4/48* (2006.01)

(52) U.S. Cl. ..... 439/759

(58) Field of Classification Search ..... 439/759, 439/799, 754, 716, 762, 773, 755
See application file for complete search history.

(56) References Cited

U.S. PATENT DOCUMENTS

| | | | | |
|---|---|---|---|---|
| 2,037,834 | A * | 4/1936 | Sutherland | 29/246 |
| 2,412,932 | A * | 12/1946 | Williams | 29/246 |
| 3,641,473 | A * | 2/1972 | Attaway | 439/108 |
| 4,643,511 | A | 2/1987 | Gawlik et al. | |
| 4,758,188 | A * | 7/1988 | Yates | 439/759 |
| 4,826,457 | A | 5/1989 | Varatta | |
| 4,854,901 | A | 8/1989 | Vernachio | |
| 4,923,415 | A * | 5/1990 | Lee | 439/755 |
| 4,964,819 | A * | 10/1990 | Caraballo | 439/773 |
| 6,238,253 | B1 * | 5/2001 | Qualls | 439/759 |
| 7,029,338 | B1 | 4/2006 | Orange et al. | |
| 7,530,857 | B2 * | 5/2009 | Domps | 439/754 |
| 2009/0247020 | A1 * | 10/2009 | Gathman et al. | 439/759 |
| 2009/0311919 | A1 * | 12/2009 | Smith et al. | 439/759 |
| 2010/0115761 | A1 * | 5/2010 | Miller et al. | 29/623.1 |

* cited by examiner

*Primary Examiner*—T C Patel
*Assistant Examiner*—Phuong Nguyen
(74) *Attorney, Agent, or Firm*—Baker & Hosterler LLP

(57) ABSTRACT

An embodiment in accordance with the present invention provides a battery clamp with a universal design for coupling to a vehicle battery with either a top-mounted terminal or a side-mounted terminal. The present invention includes a clamp body having a top portion and a bottom portion, a clamp axle coupling the top portion of the clamp body to the bottom portion of the clamp body, top terminal contacts positioned at the clamping end of each of the top portion and the bottom portion of the clamp body, and side terminal contacts positioned adjacent to the clamp axle.

22 Claims, 3 Drawing Sheets

BATTERY CLAMP

FIELD OF THE INVENTION

The present invention relates generally to charging a vehicle battery. More particularly, the present invention relates to a battery clamp for use in charging vehicle batteries.

BACKGROUND OF THE INVENTION

Vehicle batteries can be manufactured with terminals for charging the battery mounted on the top or the side of the battery. Battery clamps are commonly used to connect a battery that has lost its charge to a charging source, such as another vehicle battery or a charging station. Therefore, battery clamps come with contacts for connecting to either a top or a side terminal of a battery as the terminals are configured differently. However, it is necessary to carry at least two sets of battery clamps, one for terminals on the top of a battery and one for terminals on the side terminal of a battery, depending on what type of battery will need to be charged.

Accordingly, it is desirable to provide a clamp with a universal design such that it can be coupled to both top terminal and side terminal batteries.

SUMMARY OF THE INVENTION

The foregoing needs are met, to a great extent, by the present invention, wherein in one aspect an apparatus is provided that in some embodiments includes a universal design for a battery clamp such that it can be coupled to both a terminal mounted on the top of a battery or a terminal mounted on the side of a battery.

In accordance with one aspect of the present invention, a battery clamp for clamping to a vehicle battery is provided, which can comprise a clamp body having a top portion and a bottom portion and each of the top portion and the bottom portion having a clamping end to clamp to the vehicle battery and a compression end, a clamp axle coupling the top portion of the clamp body to the bottom portion of the clamp body, top terminal contacts positioned at the clamping end of each of the top portion and the bottom portion of the clamp body, and side terminal contacts positioned adjacent to the clamp axle.

In accordance with another aspect of the present invention, a battery clamp for clamping to a vehicle battery is provided, which can comprise a clamping means having a top portion and a bottom portion and each of the top portion and the bottom portion having a clamping end to clamp to the vehicle battery and a compression end, a coupling means for connecting the top portion of the clamp body to the bottom portion of the clamp body, first contacting means positioned at the clamping end of each of the top portion and the bottom portion of the clamp body, and second contacting means positioned adjacent to the clamp axle.

In accordance with yet another aspect of the present invention, a method of clamping a battery clamp to a vehicle battery is provided and includes the steps of providing a clamp body having a top portion and a bottom portion coupled together by a clamp axle and side terminal contacts positioned on the sides of the clamp axle, wherein the clamp axle includes a rotating means at one end and is threaded at a second end, positioning the clamp body next to a terminal of the vehicle battery to be charged, clamping the top portion and the bottom portion onto a top terminal of the battery if it is a top terminal vehicle battery, and rotating the rotating means in a first direction so that the threaded end of the clamp axle can mate with a threaded portion a side terminal vehicle battery and so the side terminals contact the side terminals of side terminal vehicle battery.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
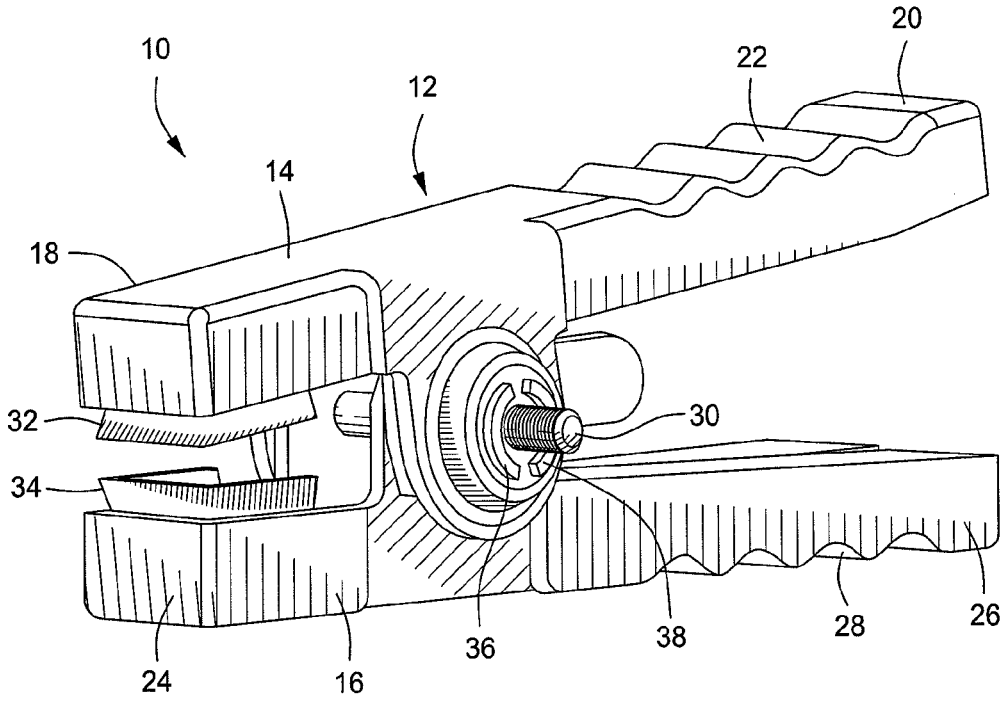
FIG. 1 illustrates a perspective view a battery clamp having top terminal contacts and side terminal contacts in accordance with an embodiment of the invention.

The invention will now be described with reference to the drawing figures, in which like reference numerals refer to like parts throughout. An embodiment in accordance with the present invention provides a battery clamp with a universal design for coupling to a vehicle battery with either a top-mounted terminal or a side-mounted terminal or both. The present invention includes a clamp body having a top portion and a bottom portion, a clamp axle coupling the top portion of the clamp body to the bottom portion of the clamp body, top terminal contacts positioned at a clamping end of each of the top portion and the bottom portion of the clamp body, and side terminal contacts positioned adjacent to the clamp axle.

FIG. 1 illustrates a perspective view a battery clamp 10 having top terminal contacts and side terminal contacts in accordance with an embodiment of the invention. The battery clamp 10 has a body 12 that includes a top portion 14 and a bottom portion 16. The top portion 14 includes a clamping end 18 and a compression end 20. The compression end 20 of the top portion 14 includes a grip region 22. The grip region 22 can take the form of ridges or other texture to provide friction such that a user's hand does not slip during use of the battery clamp 10. The bottom portion 16 also includes a clamping end 24 and a compression end 26. The compression end 26 of the bottom portion 16 includes a grip region 28. The grip region 28 can take the form of ridges or other texture to provide friction, such that the user's hand does not slip during use of the battery clamp 10. In one embodiment, the grip regions 22, 28 can be made of elastomeric materials for a soft grip.

The battery clamp 10 also includes a clamp axle 30 coupling the top portion 14 of the clamp body 12 to the bottom portion 16 of the clamp body 12. The battery clamp 10 is configured such that when the compression ends 20 and 26 are compressed together, the top portion 14 and the bottom portion 16 pivot on a fulcrum provided by the clamp axle 30. When the compression ends 20 and 26 are compressed together or in a first direction, the clamping ends 18 and 24 open away from one another in a second direction and in an opposite direction to the first direction. In this position, the user can place the clamping ends 18 and 24 on the terminal of the battery.

Additionally, the battery clamp 10 includes top terminal contacts 32, 34. The top terminal contacts 32, 34 are positioned to make contact with a top terminal of the battery, in the case that the battery with top mounted terminals needs to be charged. Top terminal contact 32 is mounted to the top portion 14 of the battery clamp body 12, and top terminal contact 34 is mounted to the bottom portion 16 of the battery clamp body 12. The battery clamp 10 also includes side terminal contacts 36, 38. The side terminal contacts 36, 38 are positioned to make contact with a side terminal of the battery, in the case that a battery with side mounted terminals needs to be charged.

Figure 2:
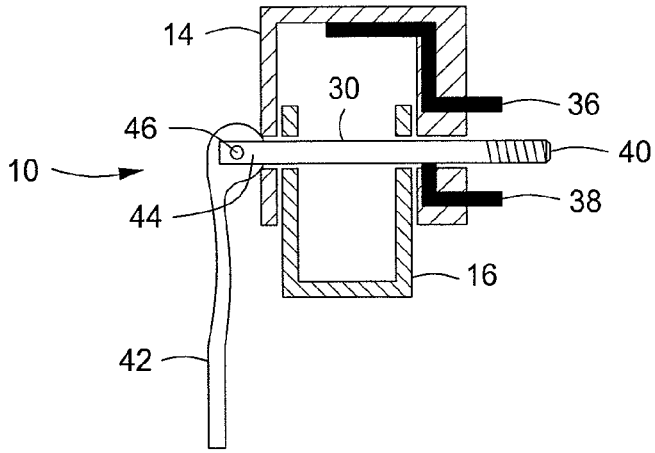
FIG. 2 illustrates a cross-sectional view of a battery clamp having top terminal contacts and side terminal contacts in accordance with an embodiment of the invention.

FIG. 2 illustrates a cross-sectional view of a battery clamp having top terminal contacts and side terminal contacts in accordance with an embodiment of the invention. As shown in FIG. 2, the bottom portion 16 of the battery clamp body 12 nests within the top portion 14 of the battery clamp body 12. In another embodiment, the top portion 14 nests within the bottom portion 16. The first side terminal contact 36 is mounted on the top portion 14 of the battery clamp body 12, and second side terminal contact 38 is mounted on the bottom portion 16 of the battery clamp body 12. The top portion 14 and the bottom portion 16 of the battery clamp body 12 pivot on the clamp axle 30.

FIG. 2 also illustrates that the clamp axle 30 extends past a side of the battery clamp body 12 and has threads 40 at least at an end to complimentarily match the threads on the side terminal of a battery. A toggle clamp 42 is attached to a non-threaded end 44 of the clamp axle 30 with a pin 46. The toggle clamp 42 is rotated in a first direction to tighten the threads 40 of the clamp axle 30 onto the side terminal threaded connection, such that the side terminal contacts 36, 38 are brought into contact with the side terminal of the battery. The toggle clamp 42 is rotated in a second direction to loosen the threads 40 and to allow the terminal contacts 36, 38 to retract from the side terminal of the battery. Alternately, the toggle clamp 42 can be depressed to tighten the threads 40 of the clamp axle 30 onto the side terminal threaded connection, such that the side terminal contacts 36, 38 are brought into contact with the side terminal of the battery. The toggle clamp 42 can be unpressed to untighten the threads 40 and release the side terminal contacts 36, 38 from the side terminal of the battery.

Figure 3:
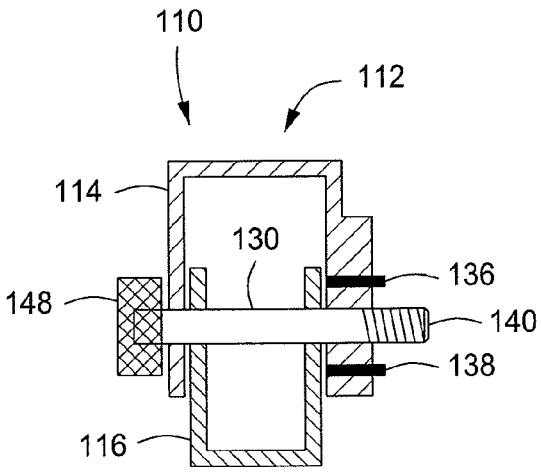
FIG. 3 illustrates a cross-sectional view of a battery clamp having top terminal contacts and side terminal contacts in accordance with an embodiment of the invention.

FIG. 3 illustrates a cross-sectional view of a battery clamp 110 having top terminal contacts and side terminal contacts in accordance with an embodiment of the invention. As shown in FIG. 3, a bottom portion 116 of a battery clamp body 112 nests within a top portion 114 of the battery clamp body 112. A first side terminal contact 136 is mounted on the top portion 114 of the battery clamp body 112, and a second side terminal contact 138 is mounted on the bottom portion 116 of the battery clamp body 112. The top portion 114 and the bottom portion 116 of the battery clamp body 112 pivot on a clamp axle 130.

FIG. 3 also illustrates that the clamp axle 130 extends past a side of the battery clamp body 112 and has threads 140 on an end to complimentarily match the threads on the side terminal of a battery. A knurled nut 148 is mounted on a non threaded end of the clamp axle 130. The knurled nut 148 is tightened by rotating it in a first direction to tighten the threads 140 of the clamp axle 130 onto the side terminal threaded connection, such that the side terminal contacts 136, 138 are brought into contact with the side terminal of the battery. The knurled nut 148 is loosened by rotating it in a second direction such that the side terminals contacts 136, 138 are retracted from the side terminal of the battery.

Figure 4:
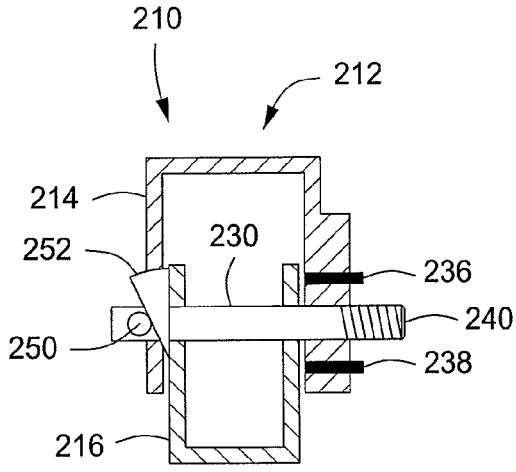
FIG. 4 illustrates a cross-sectional view of a battery clamp having top terminal contacts and side terminal contacts in accordance with an embodiment of the invention.

FIG. 4 illustrates a cross-sectional view of a battery clamp 210 having top terminal contacts and side terminal contacts in accordance with an embodiment of the invention. As shown in FIG. 4, a bottom portion 216 of a battery clamp body 212 nests within a top portion 214 of the battery clamp body 212. A side terminal contact 236 is mounted on the top portion 214 of the battery clamp body 212, and a second side terminal contact 238 is mounted on the bottom portion 216 of the battery clamp body 212. The top portion 214 and the bottom portion 216 of the battery clamp body 212 pivot on a clamp axle 230. The top portion 214 can receive the bottom portion 216 or vice versa.

FIG. 4 also illustrates that the clamp axle 230 extends past the side of the battery clamp body 212 and has threads 240 on one end to complimentarily match the threads on the side terminal of a battery. The action of the battery clamp 210 closing a pin 250 to move up a ramp 252, causing tension on the clamp axle 230 and tightening the threads 240 of the clamp axle 230 onto the side terminal threaded connection, such that the side terminal contacts 236, 238 are brought into contact with the side terminal of the battery. By moving the pin 250 down the ramp 252, the threads 240 will loosen from the battery and the side terminal contacts 236, 238 will retract from the side terminal of the battery.

Figure 5:
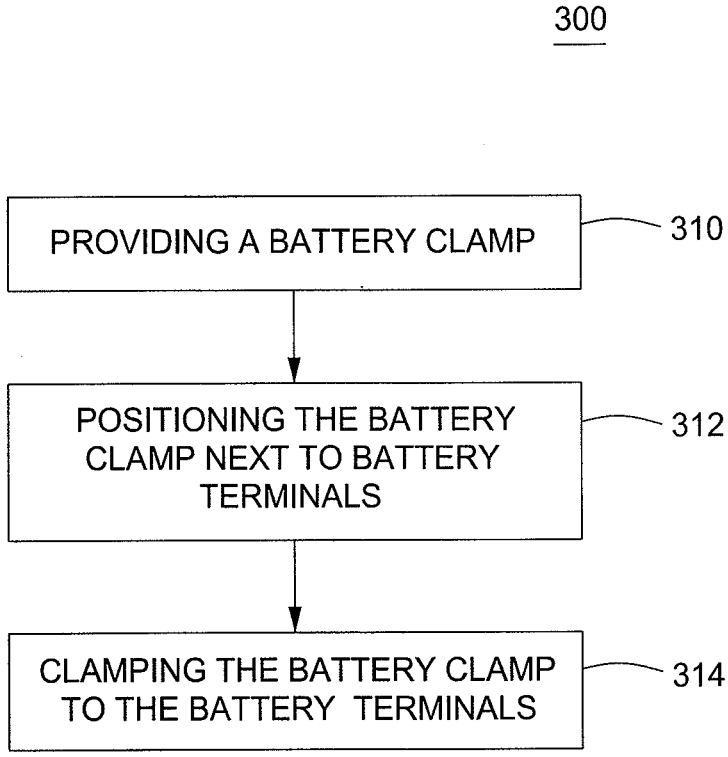
FIG. 5 illustrates a method of clamping in accordance with an embodiment of the invention.

FIG. 5 illustrates a clamping method 300 in accordance with an embodiment of the invention. At step 310, providing a battery clamp that includes a clamp body having a top portion and a bottom portion and each of the top portion and the bottom portion having a clamping end and a compression end. The clamp body further includes the clamp axle having threads at a first end and a toggle clamp at the second end that is attached with the pin and the clamp body further includes the side terminal contacts 36, 38. The clamp axel couples the top and bottom portions together. At step 312, positioning the battery clamp next to the battery terminals. At step 314, clamping the battery clamp onto the battery terminals. If the battery has top terminals, then clamping is done by contacting the clamping end of each of the top portion and the bottom portion of the clamp body to the battery terminals. If the battery has side terminals then, rotating the toggle so that the threaded end of the clamp body is threaded to the threaded side terminals of the battery and that the side terminal contacts are pressed to the side terminals of the battery. Alternately, step 312 can include configuring a toggle clamp to be depressed to tighten the threaded rod onto the threaded side terminal of the battery and press the side terminal contacts onto the side terminal of the battery, or coupling a knurled nut to an end of the threaded rod, which is rotated to tighten the threaded rod onto the threaded side terminal of the battery and press the side terminal contacts onto the side terminals of the battery. In another embodiment, step 312 can also include extending the clamp axle from one side of the battery clamp and threading it such that it can be coupled to a threaded side terminal of a battery with the compression of the clamp body compression ends, such that the side terminal contacts are pressed to the side terminals of the battery.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A battery clamp for clamping to a vehicle battery, comprising:

a clamp body having a top portion and a bottom portion and each of the top portion and the bottom portion having a clamping end to clamp to the vehicle battery and a compression end;

a clamp axle connecting the top portion of the clamp body to the bottom portion of the clamp body;

a plurality of top terminal contacts positioned at the clamping end of each of the top portion and the bottom portion of the clamp body;

a toggle clamp connected to an end of the clamp axle; and a plurality of side terminal contacts positioned at the clamp axle, wherein when the toggle clamp, when rotated, tightens the clamp axle onto a threaded side terminal of the battery and press the plurality of side terminal contacts onto a side terminal of the battery.

2. The battery clamp of claim 1, wherein the clamp axle is threaded at one end such that it mates with the threaded side terminal of the battery, such that the plurality of side terminal contacts are pressed to the side terminal of the battery.

3. The battery clamp of claim 1, wherein the toggle clamp is depressed to tighten the clamp axle onto the threaded side terminal of the battery and press the plurality of side terminal contacts onto the side terminal of the battery.

4. The battery clamp of claim 1, wherein the clamp axle comprises a rod extending from one side of the battery clamp and threaded such that it connects to the threaded side terminal of the battery with the compression of the clamp body such that the plurality of side terminal contacts are pressed to the side terminal of the battery.

5. The battery clamp of claim 1, wherein the top portion is received within the bottom portion.

6. The battery clamp of claim 1, wherein the bottom portion is received within the top portion.

7. The battery clamp of claim 1, wherein the compression end include a grip region.

8. The battery clamp of claim 7, wherein the grip region is made from an elastomeric material.

9. The battery clamp of claim 7, wherein the grip region includes ridges.

10. A battery clamp for clamping to a vehicle battery, comprising:

a clamping means having a top portion and a bottom portion and each of the top portion and the bottom portion having a clamping end to clamp to the vehicle battery and a compression end;

an axle means for connecting the top portion of the clamping means to the bottom portion of the clamping means;

a plurality of first contacting means positioned at the clamping end of each of the top portion and the bottom portion of the clamping means;

a toggle means is configured to be connected to an end of the axle means; and a plurality of second contacting means positioned at the axel means, wherein the axel means is threaded at one end such that it can be coupled to a threaded side terminal of the battery, and the toggle means, when rotated, tightens the axle means onto the threaded side terminal of the battery and press the plurality of second contacting means onto the side terminal of the battery.

11. The battery clamp of claim 10, wherein the toggle means is depressed to tighten the axle means onto the threaded side terminal of the battery and press the plurality of second contacting means onto the side terminal of the battery.

12. The battery clamp of claim 10, wherein the axle means comprises a rod extending from one side of the battery clamp and threaded such that it connects to the threaded side terminal of the battery with the compression of the clamping means, such that the plurality of second contacting means are pressed to the side terminal of the battery.

13. The battery clamp of claim 10, wherein the top portion is received within the bottom portion.

14. The battery clamp of claim 10, wherein the bottom portion is received within the top portion.

15. The battery clamp of claim 10, wherein the compression end include a grip region.

16. The battery clamp of claim 15, wherein the grip region is made from an elastomeric material.

17. The battery clamp of claim 15, wherein the grip region includes ridges.

18. A method of clamping a battery clamp to a vehicle battery, comprising:

providing a clamp body having a top portion and a bottom portion connected together by a clamp axle and a plurality of side terminal contacts positioned at the sides of the clamp axle, wherein the clamp axle includes a clamping means, a pin connected to the clamping means at one end and is threaded at a second end;

positioning the clamp body next to a terminal of the vehicle battery to be charged;

clamping a plurality of contacts of the top portion and the bottom portion onto a top terminal of the battery, if it is a top terminal vehicle battery; and rotating the clamping means in a first direction so that the threaded end of the pin mate mates with a threaded portion of a side terminal battery, if it is a side terminal battery and so that the plurality of side terminal contacts mates with the side terminal battery.

19. The method of claim 18, wherein clamping means is a toggle.

20. The method of claim 18, wherein the clamping means is a knurled nut.

21. The method of claim 18 further comprising:

unclamping the plurality of contacts of the top portion and the bottom portion from the top terminal of the battery.

22. The method of claim 18 further comprising:

rotating the clamping means in a second direction so that the threaded end of the pin releases from the threaded portion of the side terminal battery and the plurality of side terminal contacts releases from the side terminal battery.

* * * * *